United States Patent [19]

Meyer

[11] 4,306,228

[45] Dec. 15, 1981

[54] SECURITY ALARM SYSTEM MONITORING DIFFERENCE BETWEEN SOUND SIGNAL COMPONENTS IN TWO FREQUENCY RANGES

[75] Inventor: Günther Meyer, Uetersen, Fed. Rep. of Germany

[73] Assignee: Licentia Patent-Verwaltungs-G.m.b.H., Frankfurt am Main, Fed. Rep. of Germany

[21] Appl. No.: 110,116

[22] Filed: Jan. 7, 1980

[30] Foreign Application Priority Data

Jan. 8, 1979 [DE] Fed. Rep. of Germany ..... 2900444

[51] Int. Cl.[3] ..... G08B 13/00; G08B 13/20

[52] U.S. Cl. ..... 340/566; 340/565

[58] Field of Search ..... 340/566, 554, 565; 367/94, 93

[56] References Cited

U.S. PATENT DOCUMENTS 3,614,724 10/1971 Brown et al. ..... 340/566
3,885,234 5/1975 Fujimoto ..... 367/94
4,012,730 3/1977 Nicholls ..... 340/554
4,097,853 6/1978 Francis, Jr. ..... 367/94
4,134,109 1/1979 McCormick et al. ..... 340/566

*Primary Examiner*—Glen R. Swann, III
*Attorney, Agent, or Firm*—Spencer & Kaye

[57] ABSTRACT

A method and system for evaluating output signals from at least one sound pickup of a security alarm system and for generating an alarm signal by performing the following operations: before the system is placed into operation, determining a first signal frequency range containing the frequency of a signal to be determined and a second signal frequency range containing the frequency of an interference signal; then, during operation, filtering the two frequency range components out of the sound pickup output signals, each component containing a respective one of the frequency ranges, comparing the amplitudes of the two frequency components to one another and generating a difference signal representative of the difference therebetween, and generating an alarm signal whenever the difference signal traverses a threshold value.

6 Claims, 5 Drawing Figures

SECURITY ALARM SYSTEM MONITORING DIFFERENCE BETWEEN SOUND SIGNAL COMPONENTS IN TWO FREQUENCY RANGES

BACKGROUND OF THE INVENTION

The present invention relates to a method and circuit for evaluating output signals from one or more sound pickups of a monitoring system, particularly an open-air monitoring system, and for generating an alarm signal.

It is generally known to protect objects by means of alarm systems including sensors to detect signals which actuate an alarm and which are generated, for example, by a person approaching the object to be protected. Such sensors may be, for example, sound pickups, e.g. body vibration pickups, water vibration pickups, etc., photoelectric sensors, or the like. The signals detected by these sensors are processed by means of appropriate circuitry and are used to actuate an alarm, usually when a given threshold is exceeded in one direction or another.

All known alarm systems also have in common that they can be made to emit false alarms as a result of interference signals. This is particularly likely in the case of open-air monitoring systems in which various environmental influences produce a number of interference signals. It is known to attempt to eliminate such interference signals by specific circuitry measures and in particular to prevent such interference signals from exceeding in amplitude the signals to be detected. There thus occurs, in the prior art alarm systems, an amplitude evaluation which, to attain a relatively high detection probability, brings about a disadvantageously high number of false alarms.

SUMMARY OF THE INVENTION

It is therefore an object of the present invention to reduce the number of false alarms produced by an alarm system while maintaining the probability of detection high.

This and other objects are achieved, according to the invention, by the provision of a method and system for evaluating output signals from at least one sound pickup of a security alarm system and for generating an alarm signal, in which, before the system is placed into operation, a first signal frequency range containing the frequency of a signal to be detected and a second signal frequency range containing the frequency of an interference signal are determined, and then during operation, the two frequency range components are filtered out of the sound pickup output signals, each component containing a respective one of the frequency ranges, the amplitudes of the two frequency components are compared to one another and a difference signal representative of the difference therebetween is generated, and an alarm signal is produced whenever the difference signal traverses a threshold value.

A particular advantage of the invention is that it can be applied to any desired sound pickup.

According to one preferred embodiment of the invention, an evaluation of the rate of change of the difference signal, which is determined by a comparison of the filtered-out frequency signals, is made, in addition to the evaluation of the frequency range components. For this purpose, the circuit arrangement is provided with a dynamic measuring circuit unit. The rate of change of the difference signal advantageously provides further information about the source producing the detection signal or the interference signals, respectively.

DESCRIPTION OF THE PREFERRED EMBODIMENTS

Figure 1:
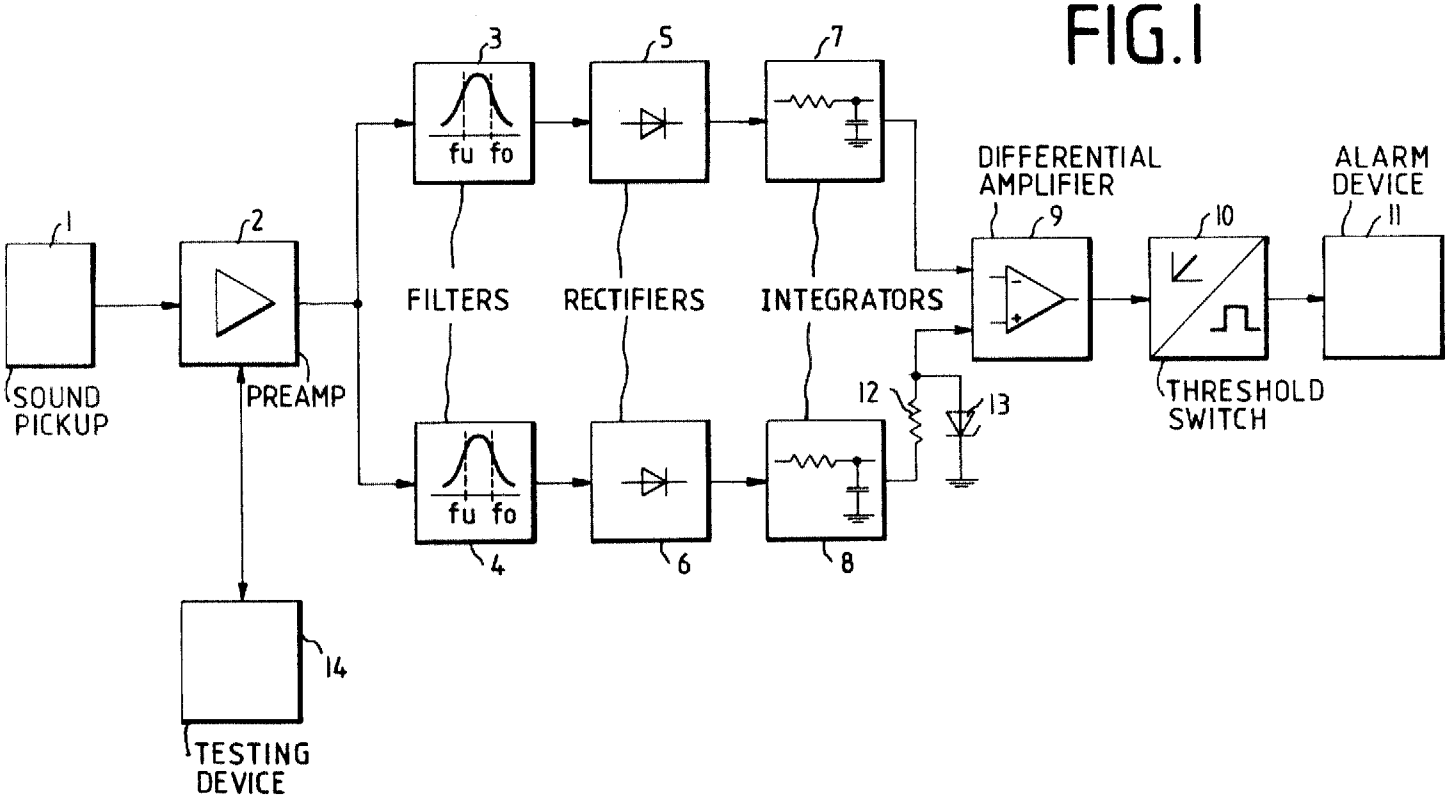
FIG. 1 is a block circuit diagram of one preferred embodiment of a circuit arrangement according to the invention for evaluating frequency range components.

The circuit arrangement of FIG. 1 includes a sound pickup 1 connected in series with a preamplifier 2 and serving as a component of an alarm system for the detection of signals which are to actuate an alarm, the so-called "signals of interest." In addition to these signals of interest, sound pickup 1 also detects interference signals which are superposed on the signals of interest.

The sound pickup 1 may be connected in parallel with further sound pickups (not shown) so that the total number of sound pickups form a so-called sensor chain. In such a sensor chain it is possible to effect the parallel connection either by connecting each one of the sound pickups in series with a respective preamplifier and connecting the outputs of the preamplifiers in parallel or in the form of a plurality of series-connected individual amplifiers, or by connecting the outputs of all sound pickups electrically to the input of the single preamplifier 2. It is also conceivable to use a sensor chain in which a plurality of sound pickups are connected in series ahead of a single preamplifier 2 or of a plurality of individual amplifiers.

The output of each preamplifier 2 is connected electrically to the inputs of two filter stages 3 and 4. The filter stages 3 and 4 have respectively different frequency transmission curves the precise configurations of which depend on the type of sound pickup 1 employed, the medium and/or the shape of the body. For example, the filter stage 3 passes a first frequency range component of the signal furnished by preamplifier 2 to cover the frequency range of the signals of interest. The filter stage 4, however, passes a second frequency range component of the preamplifier output signal which covers a range that is characteristic for interference signals. The frequency range components are determined before the object monitoring system is put into operation, for example, by way of comparison measurements, and are set at the filter stages 3 and 4, respectively. For a fence monitoring system, for example, the center frequency for the first frequency range component, i.e. the signals of interest, lies, for example, at 700 Hz, while it is about 1.8 kHz for the second frequency range component, i.e. interference signal.

A rectifier 5 or 6 and an integrator 7 or 8 to provide a representation of the signal intensity are connected in series with each filter stage 3 and 4. The outputs of integrators 7 and 8 are connected to respective inputs of a differential amplifier 9 which derives a difference signal from the filtered-out frequency signals. That difference signal is fed to a threshold switch 10 at whose output an alarm device 11 is connected. The alarm device 11, for example a siren, emits an alarm whenever the difference signal either exceeds or falls below a given threshold value.

In order for the circuit arrangement not to be made inoperative if the amplitude of the interference signal is greater than that of the signal of interest, the circuit arrangement is provided with a safety device. This device is disposed between the integrator 8 and the differential amplifier 9 and includes, for example, a resistor 12 connected in series therebetween and a shunt-connected Zener diode 13 arranged ahead of the associated input of the differential amplifier 9. This safety device operates by limiting the operating range of the interference signal.

In order to test the operation of the circuit arrangement before putting it into operation or during monitoring operation, respectively, a testing device 14 is provided which cooperates with the preamplifier 2. The testing device 14 feeds to the preamplifier 2 variable test signals composed of signals corresponding to the signals of interest and signals corresponding to the interference signals. The testing device 14 thus permits continuous monitoring of the circuit arrangement.

Figure 2:
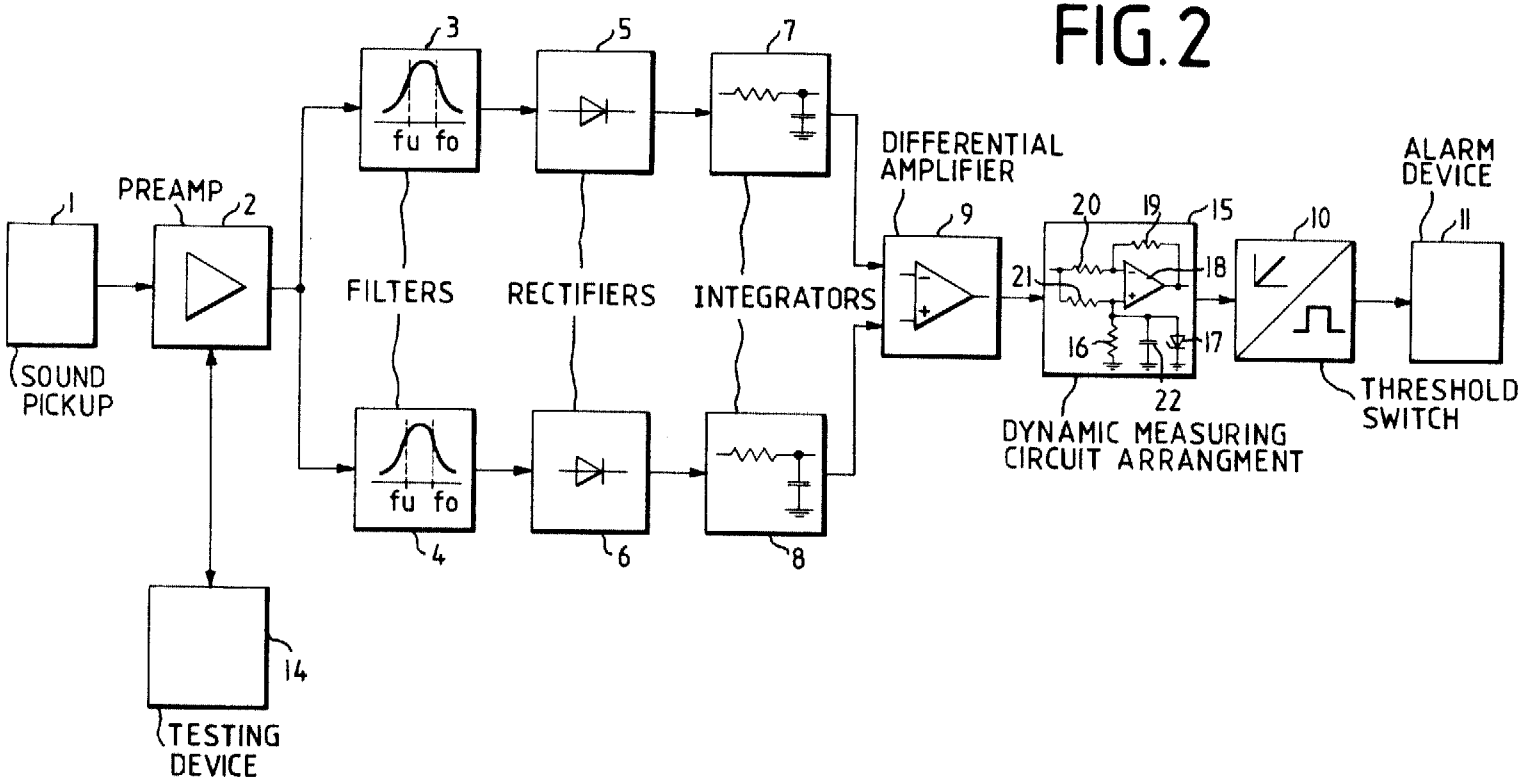
FIG. 2 is a block circuit diagram of another preferred embodiment of a circuit arrangement according to the invention which, in addition to evaluating the frequency range components, also effects an evaluation of the rate of change of a difference signal.

The circuit arrangement shown in FIG. 2 for which the reference numerals used in FIG. 1 are used to identify identical components, differs from the above-described circuit arrangement by the provision of an additional dynamic measuring circuit device 15.

The dynamic measuring circuit device 15 is disposed between the differential amplifier 9 and the threshold switch 10 and serves to evaluate the rate of change, or pattern, of the difference signal emitted by the differential amplifier 9. The evaluation is effected in that the threshold switch 10 can be switched and can furnish an output signal to the alarm device 11 only if the difference signal is within a "window" determined by the dimensions of the dynamic measuring circuit arrangement 15. The circuit arrangement 15 advantageously provides further information about the source producing the signal of interest or the interference signal, respectively. Slow or fast changes in the signals received by the sound pickup 1 can be cut out as desired and thus the number of false alarms can be reduced even further.

The block 15 in FIG. 2 shows the significant components of the dynamic measuring circuit arrangement. These are an operational amplifier 18 with associated level adjusting resistors 19, 20 and 21 as well as a parallel connection of a Zener diode 17, a resistor 16 and a capacitor 22 connected between the noninverting input of amplifier 18 and ground. Capacitor 22 ensures that only quick changes of the voltages supplied by the differential amplifier 9 (e.g. less than 0.1 s) produce an output signal at the operational amplifier 18.

Resistor 16 and Zener diode 17 constitute a safety device for limiting the operating range of the interference signal and correspond structurally and functionally to the device 12, 13 of FIG. 1. Other embodiments of such safety device are conceivable. It is also possible to eliminate the safety device provided in the dynamic measuring circuit arrangement 15 and instead, in the circuit arrangement of FIG. 2, to use the safety device provided in the circuit arrangement of FIG. 1 which is composed of the resistor 12 with shunt-connected Zener diode 13.

Figure 3:
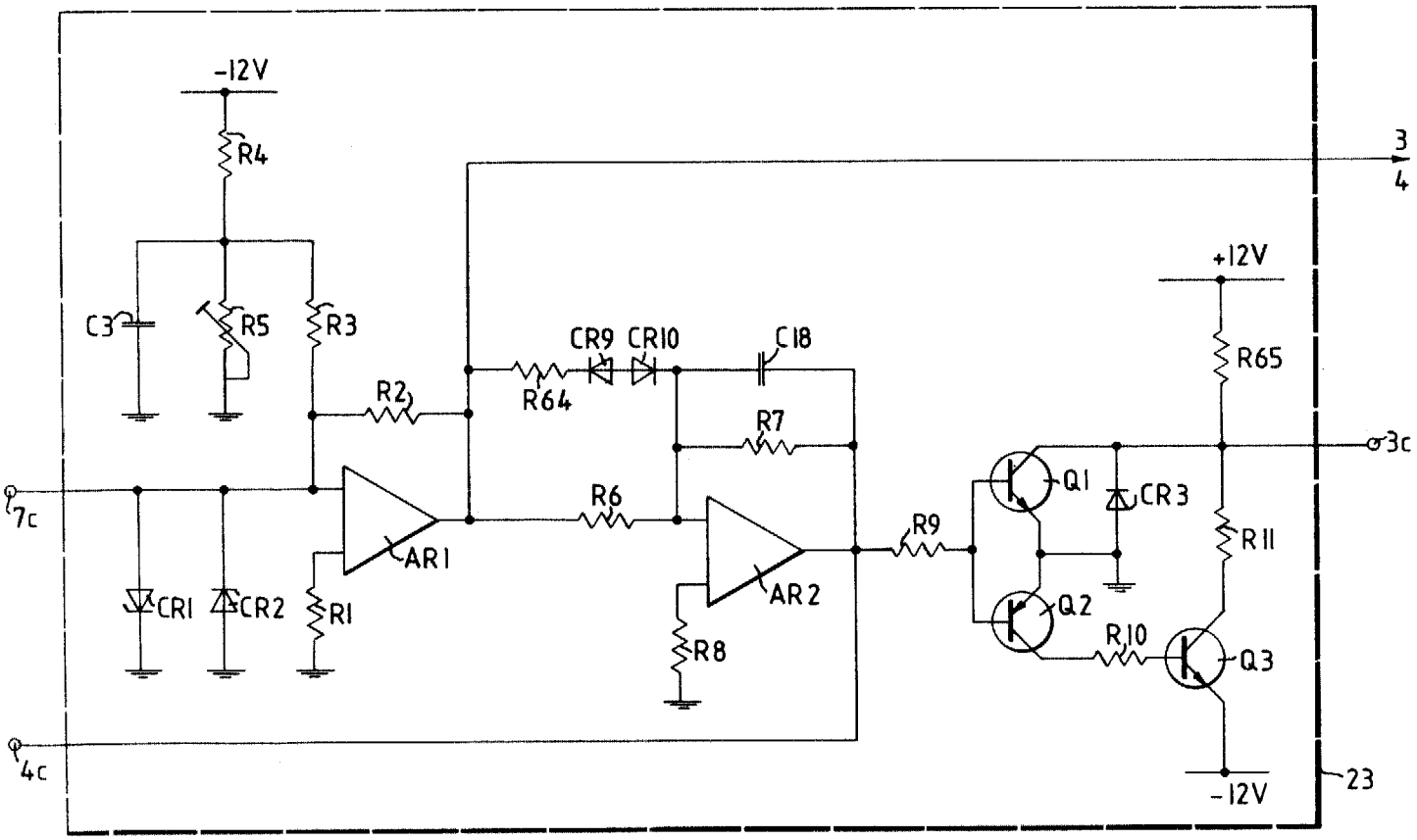
FIG. 3 is a circuit diagram for an embodiment of a testing device for testing the operation of each circuit arrangement.

In place of the testing device 14 shown in FIGS. 1 and 2, use can be made of the testing device 23 shown in FIG. 3, which serves to check the operation of the circuit arrangement before putting it into service or during monitoring operation, and which acts directly on the filter stages 3 and 4 rather than via the preamplifier 2. The testing device 23 has two input terminals *7c* and *4c*, the input terminal *4c* constitutes a setting input to adjust the testing device 23 and being provided, for example, with a voltage of zero volt. A current of known form is fed from one or a plurality of sound pickups 1 to the input terminal *7c*, possibly via the preamplifier 2. This known current, whose magnitude depends on the number of sound pickups 1 employed, is fed to the inverting input of an operational amplifier AR1, which input likewise receives a comparison current from a series-connected arrangement of resistors R3 and R4 connected between a source of −12 volts and the amplifier input. Resistors R3 and R4 form a voltage divider having its center tap connected to a potentiometer R5 presenting a variable resistance which can be adjusted to establish the desired comparison current value. The resistance values can be so selected that operation is possible with a maximum of ten sound pickups.

Capacitor $C_2$ shall smooth the reference current flowing through resistor R3. Resistor R1 ensures by an adequate rating of its resistance value that during monitoring operation the input currents at the inputs of the operational amplifier AR1 are equal.

The output of the operational amplifier AR1 is directly conductively connected to the inputs of the filter stages 3 and 4 as well as, via a resistor R6, to the inverting input of an operational amplifier AR2 provided with a feedback capacitor C18 to constitute an integrator, and which has associated setting and feedback components such as resistors R8, R7 and R64, and oppositely poled diodes CR9 and CR10.

The output of the integrator AR2 is connected, via a resistor R9, to the bases of two transistors Q1 and Q2 of respectively opposite polarity types, the emitters of these transistors being electrically conductively connected together. The collector of the transistor Q2 is connected, via a resistor R10, to the base of a further transistor Q3 to whose emitter there is applied a voltage of −12 volts. The collector of transistor Q3 is in electrically conductive connection, via a resistor R11, with the collector of transistor Q1 as well as, via a further resistor R65, with a current rail at a positive voltage of +12 volts.

The circuit output *3c* which can be connected directly with the input of the alarm device 11 of FIG. 1 or 2 or with the input of an additional alarm device is brought to the collector of transistor Q1. Moreover, a diode CR3 is provided between the connecting line which connects together the emitters of transistors Q1 and Q2 and the collector of the transistor.

The integrator AR2 measures a change in the signal supplied to the testing device and its integration time constant is selected in such a way that low frequency signals (LF signals) are short circuited and an output signal is present only if the change is very gradual (case of interference).

To get an output signal at the operational amplifier AR2 the input voltage has to change by at least 0.6 V during an integration time of about 0.2 s.

Depending on the direction of the change, either transistor Q1 or transistor Q2 becomes conductive. If transistor Q1 is conductive, it switches the interference output 3c directly to OV potential, i.e. ground. If the transistor Q2 is conductive, it switches the output 3c to OV potential via transistor Q3. The diode CR3 takes care that, during switching of Q3, the output 3c is held at −0.7 V. In the case without interference, output 3c is at +12 V potential.

To get a potential of O V at the output 3c there shall be a signal of −0.7 V at the output of the operational amplifier AR2 if the transistors $Q_2$ and $Q_3$ are conductive, resp. a signal of +0.7 V if transistor $Q_1$ is conductive.

An attempt to deceive the signal evaluation by slowly feeding in noise, e.g. by exposing a sound pickup to a portable tape recorder, is prevented by the diodes CR9 and CR10 and their preresistor R64. If the LF signals which are supplied by a sound pickup exceed for a period of about 0.2 s 5.4 Vp, the diodes CR9 and CR10 connect through. The result is a parallel connection of the resistors R64 and R6 and, therefore, a doubling of the amplification factor of the operational amplifier AR2. If the input signal increases to a peak voltage of about 5.7 Vp, the output voltage at the operational amplifier AR2 exceeds 0.7 V and switches the testing device on.

Figure 4:
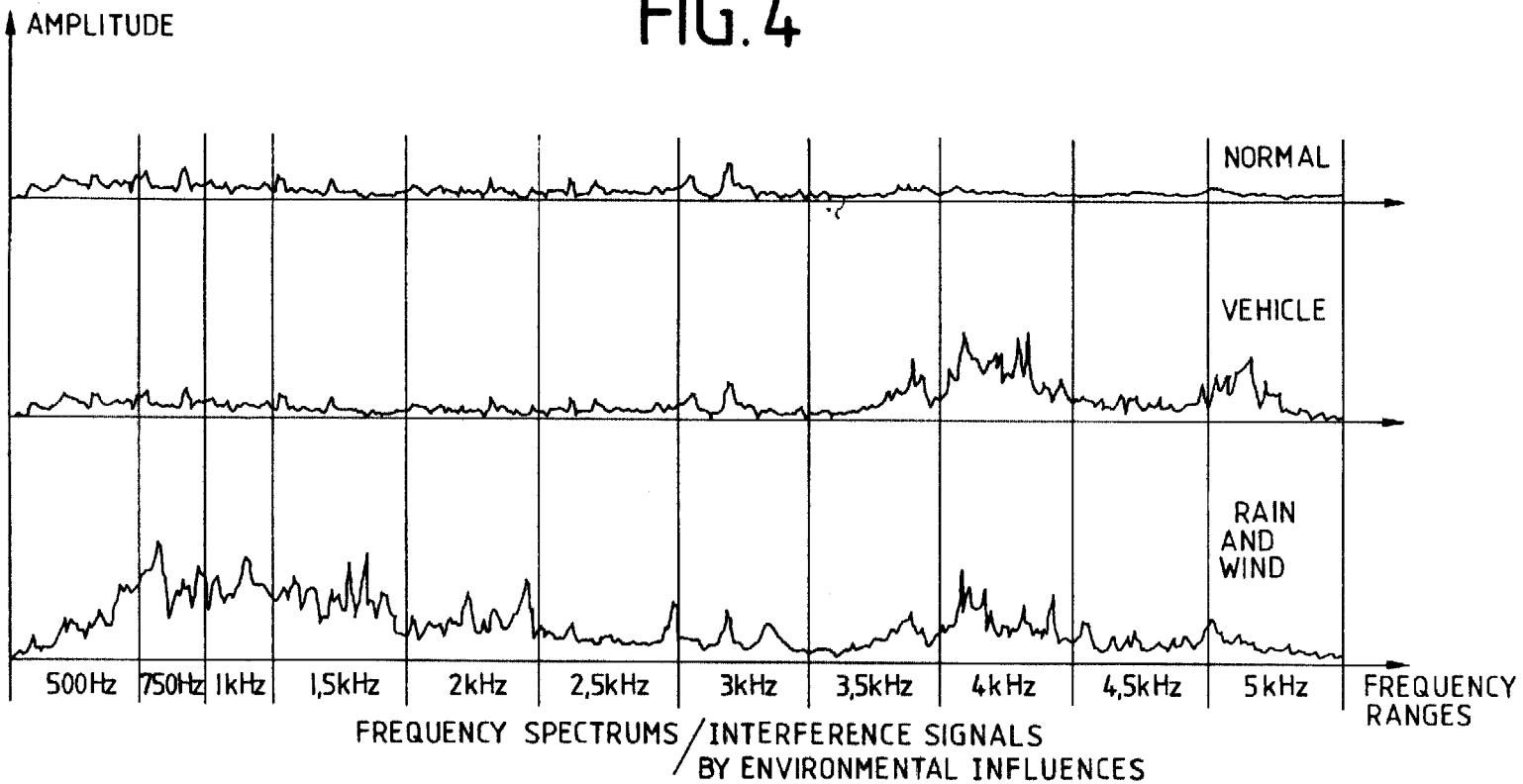
FIG. 4 shows frequency spectrums for interference signals.
Figure 5:
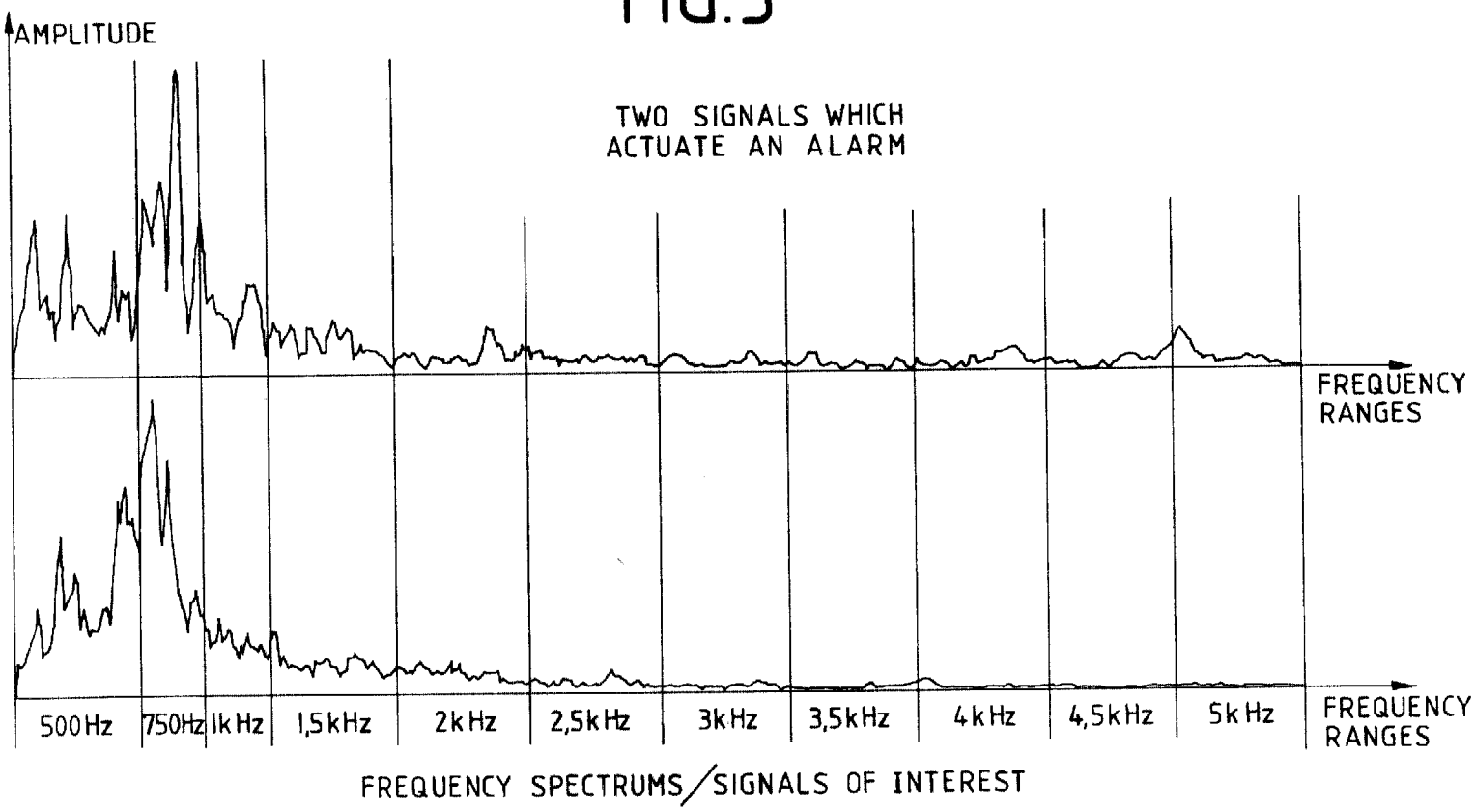
FIG. 5 shows frequency spectrums for signals of interest.

FIG. 4 and FIG. 5 show frequency spectrums of signals if the security alarm system is put into operation, of signals of interest and of interference signals.

The rectifiers 5 and 6 are double-wave rectifiers. The integration time of integrator 7 is about $74.8 \cdot 10^{-3}$ s, and of integrator 8 about $2.4 \cdot 10^{-3}$ s. The threshold values of the threshold switch 10 are adjustable, e.g. from 0.1 to 2 V.

The testing device 23 shown in FIG. 3 comprises the testing device 14 and the preamplifier 2 of FIG. 2, the operational amplifier AR1 (FIG. 3) corresponds to the preamplifier 2 (FIG. 2). The evaluation of the alarm by the filters 3 and 4 continues even if the testing device is put into operation.

The lower and upper cutoff frequencies for the filters 3 and 4 can have the following values:

filter 3:

$f_u$=0,399 KHz $f_o$=0,932 KHz filter 4:

$f_u$=1,45 KHz $f_o$=2,10 KHz

The interference signals are for example produced by environmental influences or by passing cars (FIG. 4). Signals of interest are signals which are caused by a person approaching the object to be protected. A signal of interest is for example produced by the destruction of the alarm system. The frequency spectrums for such cases are shown in FIG. 5.

It will be understood that the above description of the present invention is susceptible to various modifications changes and adaptations, and the same are intended to be comprehended within the meaning and range of equivalents of the appended claims.

What is claimed is:

1. A method for evaluating output signals from at least one sound pickup of a security alarm system and for generating an alarm signal comprising: before the system is placed into operation, determining a first signal frequency range containing the frequency of a signal to be detected and a second signal frequency range different from the first range and containing the frequency of an interference signal, said step of determining including performing comparison measurements to determine the frequency distribution of useful and interference signals; then separating from the sound pickup output signals two frequency components each containing a respective one of the frequency ranges; comparing the amplitudes of the two frequency components to one another and generating a difference signal representative of the difference therebetween; evaluating the rate of change of the difference signal; and generating an alarm signal whenever the rate of change of the difference signal traverses a threshold value.

2. A security alarm system comprising:

at least one sound pickup;

at least one preamplifier connected to receive output signals produced by said pickup;

two filter stages each connected to receive the output signal from said preamplifier, and constructed to have respectively different frequency characteristics, the characteristic of one stage being such that it passes signals in a first frequency range containing the frequency of a signal to be detected and the characteristic of the other said stage being such that it passes signals in a second frequency range different from the first range and containing the frequency of an interference signal;

two rectifiers each connected to rectify the signals passed by a respective one of said filter stages;

two integrators each connected to derive an output signal representative of the time integral of the rectified signal from a respective one of said filter stages;

comparison means including a differential amplifier having two inputs each connected to the output of a respective integrator, for providing a signal representative of the difference between the signals at its inputs, and a dynamic measuring circuit connected to the output of said differential amplifier for causing the signal at the output of said comparison means to be proportional to the rate of change of the difference signal;

a threshold switch connected to the output of said comparison means for producing an output signal each time the signal at said comparison means output traverses a threshold value; and an alarm device connected to receive the output signals produced by said threshold switch for producing an alarm in response thereto.

3. An arrangement as defined in claim 2 further comprising a safety device for limiting the operating range of the interference signals connected between said integrator associated with said other stage, and the associated input of said differential amplifier.

4. An arrangement as defined in claim 3 wherein said safety device comprises a resistor connected in series in its associated signal path and a Zener diode connected in shunt therewith.

5. An arrangement as defined in claim 1 further comprising a safety device connected in said dynamic measuring circuit for limiting the operating range of the interference signal.

6. An arrangement as defined in claim 5 wherein said safety device comprises a resistor and Zener diode connected in parallel therewith.

* * * * *